US005718771A

United States Patent [19]

Cassell et al.

[11] Patent Number: 5,718,771

[45] Date of Patent: Feb. 17, 1998

[54] RETRACTABLE TRAVERSING TRASH RAKE AND METHOD FOR CLEANING WEEDSCREEN

[75] Inventors: Wayne G. Cassell, League City; Wesley A. Reetz, Houston; Trent T. Gathright, Pearland, all of Tex.

[73] Assignee: Brackett Green, U.S.A., Inc., Houston, Tex.

[21] Appl. No.: 537,191

[22] Filed: Sep. 29, 1995

[51] Int. Cl.[6] ..... B08B 7/04; B66C 11/00; B66C 17/00

[52] U.S. Cl. ..... 134/42; 210/159; 210/162; 210/791; 414/460; 414/625; 414/626; 212/326; 212/344

[58] Field of Search ..... 210/159, 162, 210/791; 134/6, 42; 414/460, 626, 624, 625, 142.6; 212/344, 325, 326, 234, 339

[56] References Cited

U.S. PATENT DOCUMENTS

| | | | |
|---|---|---|---|
| 1,420,283 | 6/1922 | Randlett | 210/162 |
| 2,186,790 | 1/1940 | Smyser | 210/162 |
| 2,457,135 | 12/1948 | Deiters | 414/626 |
| 3,325,013 | 6/1967 | Cyphers | 210/159 |
| 3,549,028 | 12/1970 | Neumann | 210/159 |
| 3,572,805 | 3/1971 | Murphy | 212/339 |
| 4,725,365 | 2/1988 | Albrecht, III | 210/791 |
| 4,725,366 | 2/1988 | Dacus | 210/791 |
| 4,935,131 | 6/1990 | Pindar | 210/160 |
| 5,167,803 | 12/1992 | Newton et al. | 210/159 |
| 5,407,563 | 4/1995 | Blake | 210/155 |

*Primary Examiner*—Robert J. Warden
*Assistant Examiner*—Saeed Chaudhy
*Attorney, Agent, or Firm*—Moore & Hansen

[57] ABSTRACT

A retractable traversing trash rake is provided for cleaning weedscreens or bar grates at an installation for generating power, filtering water, or the like. The trash rake includes a frame carrying a troney movable from a position inside the frame to a position outside the frame. The trolley carries a trash rake which may be lowered to clean the weedscreen, and the trolley may be moved to a position within the frame, where the trash rake may be opened to deposit collected debris into a hopper. The hopper is pivotally mounted for tilting in opposite direction to provide multiple dumping options. A method of cleaning weedscreen by using a retractable traversing trash rake is also disclosed.

7 Claims, 4 Drawing Sheets

RETRACTABLE TRAVERSING TRASH RAKE AND METHOD FOR CLEANING WEEDSCREEN

BACKGROUND OF THE INVENTION

The present invention relates generally to the field of water-course weedscreen cleaning systems. Specifically, it relates to a retractable traversing cleaning system for cleaning water-course weedscreens.

At facilities such as pumping stations, municipal water reservoirs, power plants, and other water supply facilities, there exists a need to filter debris from water before putting the water to use. Debris from the water source may include litter, twigs, logs, leaves, branches, and the like. If this debris gets into the facility equipment, the entire system may be damaged. It is therefore necessary for assemblies known as weedscreens or bar grates to be installed over the inlet or inlets, often referred to as bays, where water is to enter the facility. A typical weedscreen includes a series of spaced apart bars aligned substantially vertically, and perpendicular to the direction of water flow. With the bar grate or weedscreen in place, the largest items of debris are filtered out of the water, and build up at the bar grate. When the debris builds up, this slows down water flow, and may even fully clog the grate. When this occurs, the bar grate or weedscreen must be cleaned to maintain efficiency.

Trash rake systems that clean the vertical bars over which water flows are known in the art. For example, one cleaning system consists of a trolley carrying a cleaning rake. The trolley moves on a monorail to the various bays of the facility. A cleaning rake carried by the trolley is then lowered across the vertical bars, cleaning them of debris as it is lowered. The cleaning rake is grapple-like, with a number of raking fingers that engage the bars of the grate or weedscreen, and a closure member that serves to retain debris when the cleaning assembly is removed from the water. Once the cleaning assembly is raised back to the trolley, the trolley must move along the monorail to a point at which the collected debris may be dumped, such as onto a pile underneath the monorail track, or onto a platform or hopper underneath the monorail track. Immediate dumping of debris may not be accomplished, since immediate dumping would result in the debris being returned to the water. The trolley must be moved to a point not above the water before dumping may occur. In transit between the cleaning site and the dumping site, any debris not securely held by the cleaning rake may fall from the rake back into the water or onto an area not suitable for dumping. Following successful dumping, the trolley must move along the monorail again to a new cleaning location.

Another product for cleaning the bays of a weedscreen of the type described is a tower-type structure or carriage that carries a raking skip. The raking skip is lowered into the water to clean the bar screen directly underneath it. The raking skip has rake teeth that engage the bars of the weedscreen as it is lowered over the grate. The debris removed from the bar screen by the raking skip must be wiped free by a wiper mounted on the carriage. The raking skip remains outside the frame, and the debris is deflected into a floor channel, skip, hopper or other container carried within the carriage by a deflection plate mounted to the carriage.

The tower-type cleaning structure with raking skip described above has also been mounted on rails such as railroad tracks, so that it may be moved from bay to bay for cleaning of multiple bays with one cleaning tower assembly.

In this type of configuration, the skip or hopper is typically wheeled, and internally mounted for manual removal, or coupled to the travelling head so as to travel with the machine. This structure still requires a wiper and deflection apparatus for removal and collection of debris from the raking skip.

All of the assemblies discussed above have a number of disadvantages. The monorail and trolley system requires that a separate site be maintained for the storage or dumping of debris. Often this site must be some distance from the weedscreens that are being cleaned. Extra time is required in order to move the trolley along the monomil to the dump or storage site, and then back to the site to be cleaned. Debris collected during cleaning may fall back into the water or at a point away from the dumping site if not securely held within the cleaning rake. Larger logs especially have a tendency not to be securely held in the cleaning rake. Transit along the monorail of this type of debris tends to be difficult.

The internally mounted skip of the tower-type structure must be wheeled out of the assembly and separately dumped at the appropriate dumping location. Special deflection equipment is required to even dump to the internally mounted skip. The raking skip is not positioned above the hopper for easy dumping of debris. Debris may spill or miss the skip entirely, resulting in additional required raking time. When debris is released, if it is not properly deflected into the skip by the deflection plate due to being blown by the wind, or being unbalanced and simply missing the skip, or being too large to properly fit the hopper, it may drop back into the water and necessitate another cleaning pass, or may drop adjacent the tower, requiring additional time and effort to remove it to an appropriate location.

SUMMARY OF THE INVENTION

The present invention is a traversing trash rake with a frame or carriage that is movable laterally to be positionable at a number of weedscreens, and a cleaning assembly that is movable not only up and down to clean weedscreens, but also between a retracted position within the frame directly above an internal hopper and an extended position substantially vertically aligned with the weedscreen to be cleaned. This configuration allows the cleaning assembly to more accurately dump debris into the internally mounted hopper. The hopper is tiltable from either end to dump debris therefrom while still situated within the frame.

To accomplish this, the traversing trash rake includes a tower structure frame which is mounted on rails such as railroad tracks, and which is movable along the rails from weedscreen bay to weedscreen bay. A hopper or skip for collection of debris is tiltably mounted within the frame. A trolley movably mounted to the frame carries a gripper rake assembly. The trolley is movable from a retracted position within the frame above the hopper to an extended position outside the frame. The trolley has guide rollers that travel along horizontally extending carrier beams. A motor assembly within the trolley powers the motion of the trolley. The carrier beams form a track on which the trolley can move from its retracted position inside the frame and above the hopper to its extended position outside the frame, in vertical alignment with the bar grate below, and ready to be lowered to clean debris. The gripper rake assembly is movable up and down to clean weedscreens of an installation such as a power plant or generating station. A hoist motor within the trolley is operable to raise and lower the gripper rake assembly.

The hopper or skip is situated within the frame underneath the trolley in its retracted position. This allows the gripper rake to dump any collected debris from the rake directly into the hopper without the increased chance of dumping debris back into the water. The hopper serves as an intermediate storage space and may later be dumped, without requiting the frame assembly or trolley to move or be moved to a remote dumping location. The hopper is tiltable from either end within the frame to dump collected debris. The hopper may be tilted to either end so as to allows selection of where to dump debris. Swingable dump doors normally form the end walls of the hopper, but also serve as ramps when debris is being dumped from the hopper. A pair of hopper hoist motors connected to hoist cables and hoist cable links are operable to raise one end of the hopper or the other to allow dumping of debris. Pivot hinges on the hopper engage locking plates on the frame to hold the non-tipped end of the hopper down during dumping.

Dumping efficiency is greatly improved by the addition of inward and outward movement by the trolley carrying the gripper rake. No deflection panel is required to deflect the debris to the proper location. The gripper rake is positioned directly above the hopper for dumping. The tiltable hopper allows for easier and quicker dumping of debris at the proper locations, without the need for repeated trips to the dumping location for each gripper rake load of debris.

The gripper rake and trolley assembly is normally in its retracted position above the hopper when the tower structure is being moved from one bay of an installation to another, and when the gripper rake is dumping debris into the hopper. When the tower reaches a cleaning position the trolley is moved by its motor along the carrier beams from its retracted position to its extended position in substantially vertical alignment with the bar screens to be cleaned by the gripper rake. The gripper rake is opened and closed by hydraulics. A hydraulic system is housed within the trolley, and hydraulic lines supply fluid to operate the hydraulic cylinders that open and close the gripper rake. The rake is opened and lowered to the bar screen, where tines or grapples on the gripper rake engage the bar screen, cleaning debris therefrom when the rake is lowered. When the bottom of the bar screen is reached, the gripper rake is closed hydraulically, and is raised to its extended position. The debris laden gripper rake is then moved inward to its retracted, or dumping, position, where the gripper rake is opened, dumping the debris into the hopper below.

Suitable control stations are supplied on each end of the tower structure. All functions of the retractable traversing trash rake are operable from the control stations, including traversing the tower structure from bay to bay, moving the trolley from retracted to extended positions, opening and closing the gripper rake, raising and lowering the gripping rake, and tilting the hopper for dumping.

These and other benefits of the present invention will become apparent from the following detailed description thereof taken in conjunction with the accompanying drawings, wherein like reference numerals designate like elements throughout the several views.

DESCRIPTION OF THE PREFERRED EMBODIMENT

Figure 1:
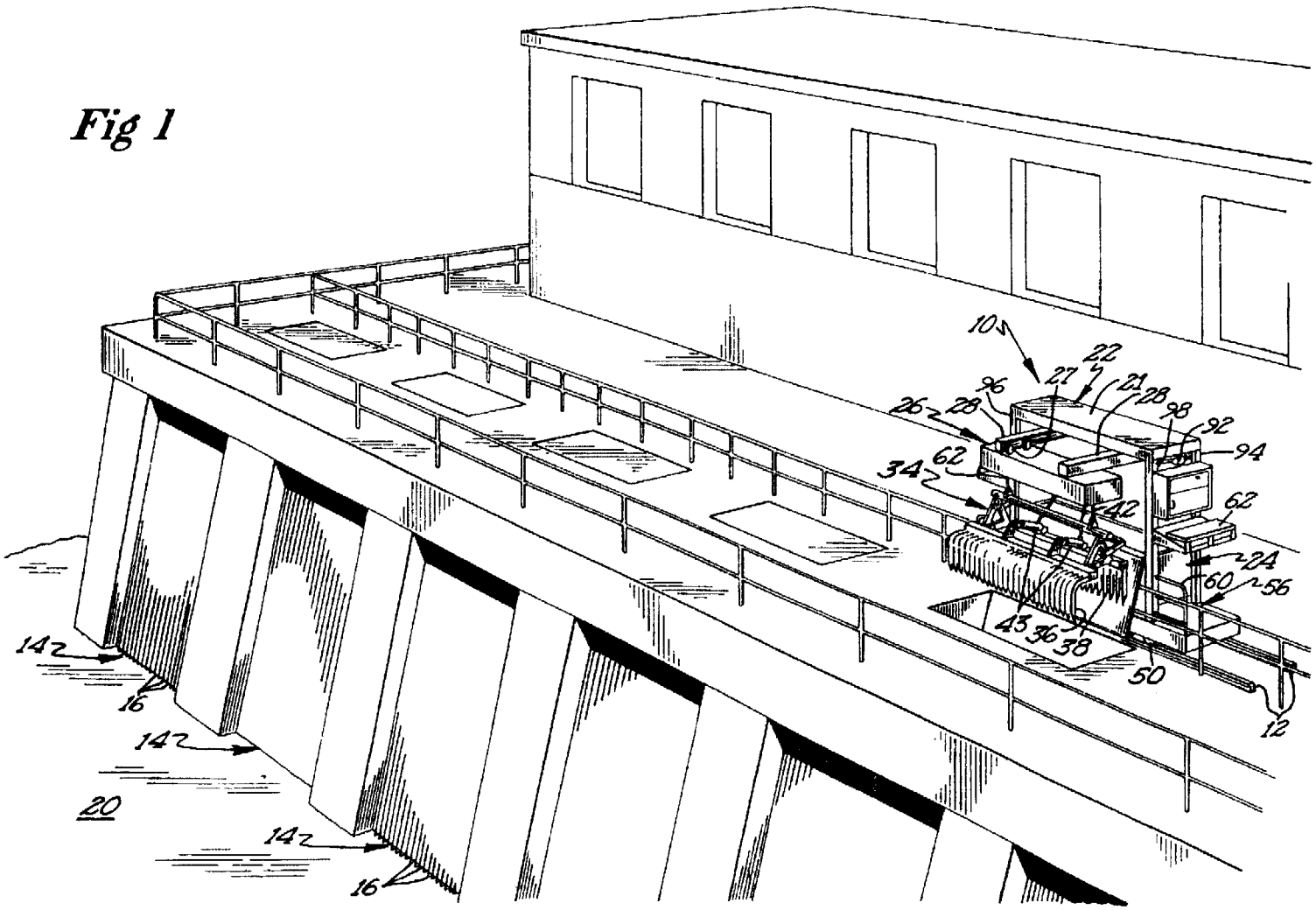
FIG. 1 is a perspective view of an embodiment of the traversing trash rake in place at a typical installation site.

Referring now to the drawings, the retractable traversing trash rake 10 may be seen in place at a typical cleaning site in FIG. 1. Retractable traversing trash rake 10 rides on rails 12 and traverses between weedscreens 14. Weedscreen 14 includes substantially vertically spaced apart bars 16. Bars 16 form a filter to filter out debris 18 (FIGS. 1–4) such as branches, logs, leaves, and litter from the water 20 flowing to the site.

Figures 4, 5:
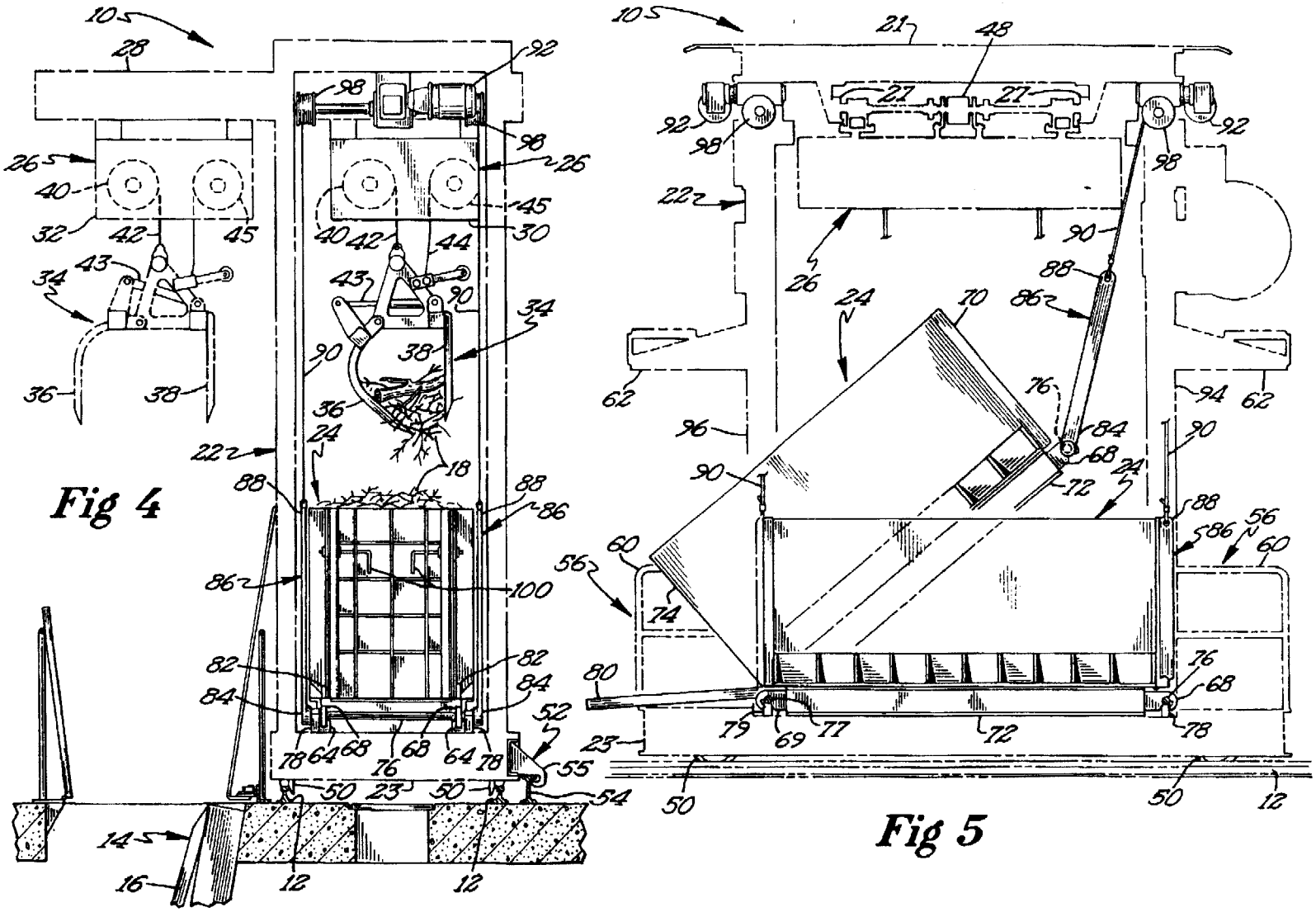
FIG. 4 is a closer side view of the gripping assembly and frame of FIG. 1, with the gripping assembly retracted, and dumping debris into the hopper.
FIG. 5 is a side view of the hopper, showing its normal level position and on of its tilted dumping positions.

Retractable traversing trash rake 10 includes a frame 22. Frame 22 carries an internal hopper or skip 24 into which debris 18 (FIGS. 2–4) may be deposited. Frame 22 carries trolley 26. Carrier beams 28 extend substantially horizontally from frame 22. Trolley 26 has guide rollers 27 that engage tracks 29 (FIG. 3) in carrier beams 28 and guide trolley 26 from a first retracted position 30 (FIG. 4) within frame 22 above hopper 24 to a second extended position 32 outside frame 22, and substantially vertically aligned within weedscreen 14 that is to be cleaned. Trolley 26 is movable between its first retracted position 30 and its second extended position 32 by operation of trolley motor 48 (FIGS. 3,5). Trolley motor 48 (FIGS. 3,5) is operatively connected to guide rollers 27 by shaft 49.

Trolley 26 carries a raking means such as gripper rake assembly 34 that includes a front line assembly 36 and a rear tine assembly 38. Gripper rake assembly 34 may be lowered, in an open position, by gripper hoist motor 40 (FIGS. 2–4) and cables 42. Gripper hoist motor 40 is situated within trolley 26. Trolley 26 also houses hydraulic assembly 45 (FIGS. 2,4) that supplies hydraulic fluid through hydraulic lines 44 (FIGS. 2–4), which extend along with cables 42. Hydraulic lines 44 supply fluid to hydraulic cylinders 43, which are operable to open and close the gripper rake assembly 34. Hydraulic lines 44 are longer than hoist cables 42 in order to avoid the weight of the gripper rake assembly 34 being borne by lines 44.

Figure 2:
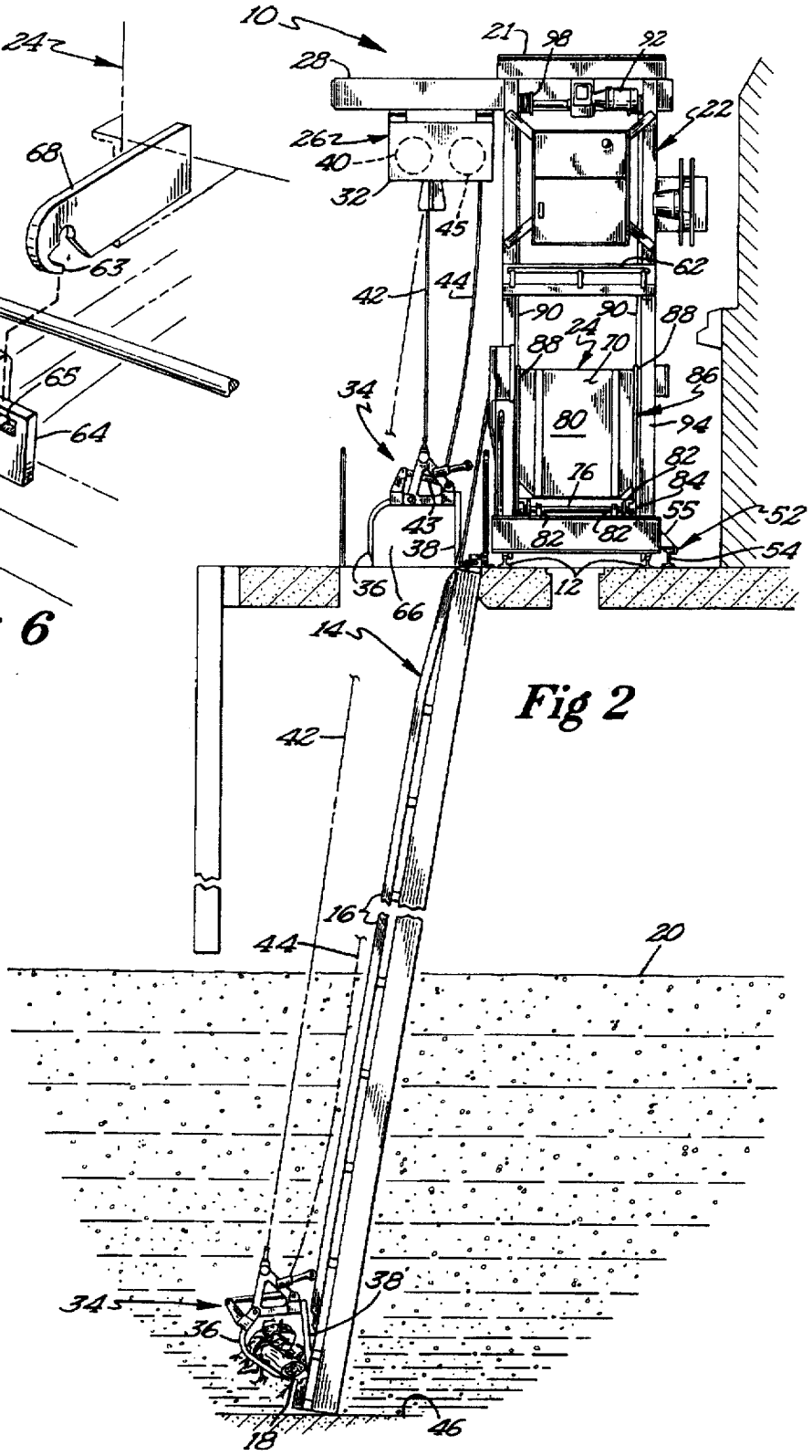
FIG. 2 is a side elevation view of the trash rake of FIG. 1, showing the gripping assembly in its open extended position and its closed retracted position.
Figure 3:
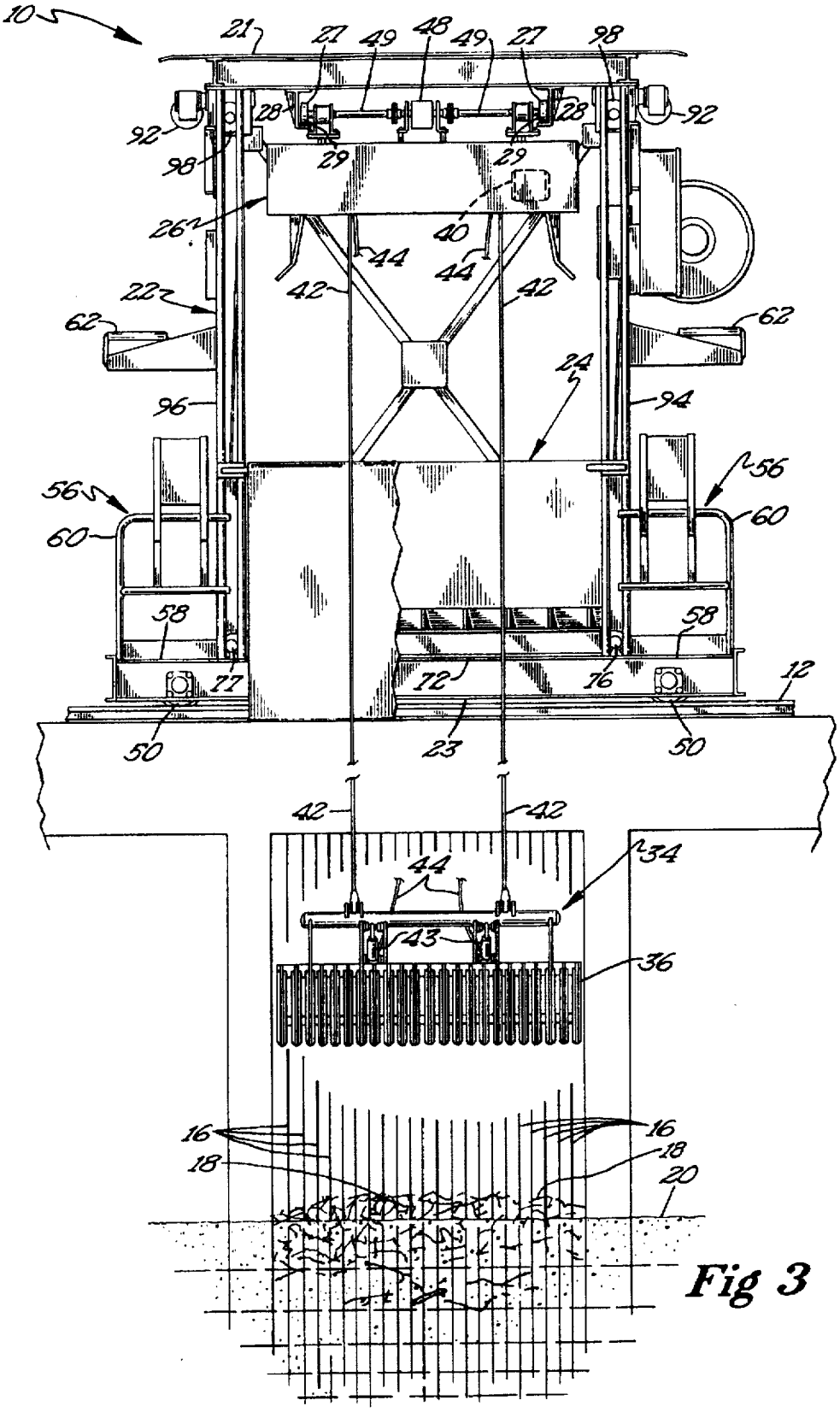
FIG. 3 is a front elevation view of the trash rake of FIG. 1, showing the gripping assembly partially lowered, and cleaning a typical gate at a typical installation site.

Referring now to FIG. 2, the retractable traversing trash rake 10 may be seen in side view. Trolley 26 is shown in its extended position 32 along carrier beams 28 with the open gripper rake assembly 34 being lowered by motor 40 and cables 42 to clean a weedscreen 14. Gripper rake assembly 34 is also shown in a closed position with front line assembly 36 and rear tine assembly 38 holding debris 18 therebetween at the bottom 46 of the water body and the weedscreen 14.

Referring now also to FIG. 3, the frame 22, trolley 26, and gripper rake assembly 34 may be seen in more detail. Frame wheels 50 ride on and engage rails 12 to allow trash rake 10 to traverse between weedscreens 14. A traversing motor (not shown) is operable to move trash rake 10 from position to position. A third rail lock 52 (FIG. 2) engages a third rail 54 to help maintain trash rake 10 in an upright position when trolley 26 is in its extended position 32 and gripper rake assembly 34 is collecting and lifting debris 18. Without third rail lock 52, trash rake 10 would be more susceptible to tipping. To further counterbalance the weight of trolley 26 and debris-laden gripper rake assembly 34, counterweight 55 is added to third rail lock 52. Frame 22 is constructed from suitably strong material to withstand the stresses placed thereon. The preferred material for the frame assembly is ASTM A. 36 carbon steel.

Retractable traversing trash rake 10 is equipped with operator control stations 56 on either side of frame 22. Operator control stations 56 each have a platform 58 on which an operator may stand, hand rails 60, and a series of controls, including a main control panel with indicator lights and controls for all functions, including traversing trash rake 10 from position to position, trolley 26 movement between retracted and extended positions, opening and closing gripper rake assembly 34, raising and lowering gripper rake assembly 34, as well as main power, hydraulic controls, and emergency shut downs. Further controls for retractable traversing trash rake 10 include low and high traversing speeds, inching controls, slack line indications, and the like, and are also located at control stations 56. Each operator control station 56 further has an overhead protective canopy 62 which will deflect any falling debris 18.

As mentioned, trolley 26 has a retracted position 30 wherein trolley 26 and gripper rake assembly 34 are retracted to within frame 22 above hopper 24. To get to its extended position 32, trolley 26 moves along guide rollers 27 and tracks 29 in carrier beams 28 to a point at which trolley 26 and gripper rake assembly 34 are in substantial vertical alignment with weedscreen 14. When cleaning a weedscreen 14, gripper rake assembly 34 is in its open position as indicated by reference numeral 66, wherein front tine assembly 36 and rear line assembly 38 are separated. Once gripper rake assembly 34 has traveled to the bottom 46 of the weedscreen 14, the hydraulic system 45 will allow an operator to actuate hydraulic cylinders 43 to close gripper rake assembly 34, bringing front tine assembly 36 into engagement with rear tine assembly 38 and holding debris 18 within gripper rake assembly 34, as is shown with gripper rake assembly 34 and trolley 26 in the retracted position 30 (FIG. 4).

Hopper or skip 24 is tiltably mounted within frame 22 substantially directly underneath trolley 26 and gripper rake assembly 34 when trolley 26 is in its retracted position 30.

Referring now to FIG. 5, the details of hopper 24 may be seen. Hopper 24 is pivotally mounted in frame 22. For this purpose, a pair of pivot hinges 68 are formed with or attached to hopper 24 at end 70 adjacent hopper bottom 72, one pivot hinge 68 at each corner. A pair of pivot hinges 69 are also formed or attached to hopper 24 at opposite end 74 to adjacent hopper bottom 72, one pivot hinge 69 at each corner. Each pivot hinge 68 engages a pivot bar 76 that also serves as a wheel axle for end 70 of hopper 24. Pivot bar 76 rests in hopper cradles 78 mounted to frame 22. Each pivot hinge 69 engages a pivot bar 77 that also serves as a wheel axle for end 74 of hopper 24. Pivot bar 77 rests in hopper cradles 79 mounted to frame 22.

Each pivot hinge 68 is affixed to or formed with hopper 24 at end 70, one hinge 68 at each corner of hopper 24 along hopper bottom 72, and extends parallel to the direction of travel of the entire frame 22. Each pivot hinge 69 is affixed to or formed with hopper 24 at end 74, one hinge 69 at each corner of hopper 24 along hopper bottom 72, and extends parallel to the direction of travel of frame 22. Each one of pivot hinges 68 and 69 is rotatably mounted to one end 84 of a respective dump hoist cable link 86. At its other end 88, each dump hoist cable link 86 is attached to a respective hopper hoist cable 90. Each of the hopper hoist cables 90 is attached to a hopper hoist motor assembly 92. There are two hopper hoist motor assemblies 92, one at each opposite end 94 and 96 of frame 22 along its top 21. Each hopper hoist motor assembly 92 is attached to the two hopper hoist cables 90 that are on the same end of the frame, 94 or 96, where the respective hopper hoist motor assembly 92 is situated. Hopper 24 may therefore be tilted on a pivot axis corresponding to either pivot bar 76 or pivot bar 77, depending upon which hopper hoist motor assembly 92 is in operation. Excess hoist cable 90 is wound onto its respective cable drum 98. The hopper 24 may be tilted with either pivot bar being the vertex of angle between frame base 23 and hopper bottom 72, to an angle $\alpha$ from the horizontal in order to accomplish dumping of debris 18 from hopper 24.

Figure 6:
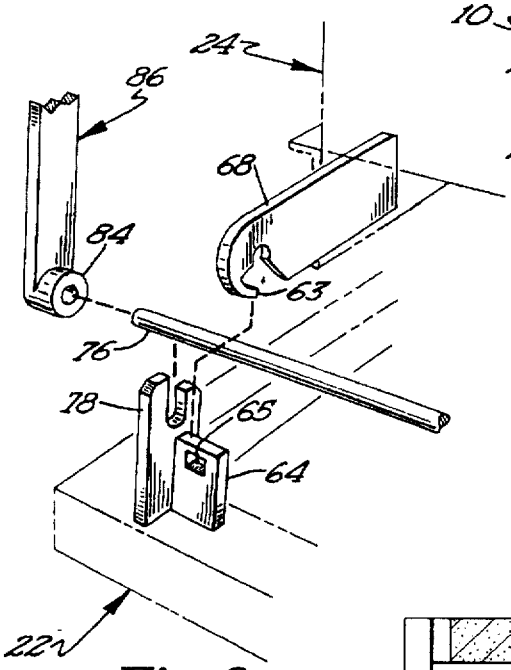
FIG. 6 is an exploded view of the pivot hinge and locking plate of FIG. 5.

Each pivot hinge 68 has extending end hook 63, as best shown in FIG. 6. A locking plate 64 is affixed to frame 22 at each pivot hinge 68 and 69. Each locking plate 64 has an opening 65 that will engage extending end hook 63 when hopper 24 is tilted. The engagement of locking plate 64 and extending hook 63 will hold end 70 of hopper 24 to the frame 22 during dumping. Similarly, if end 74 of hopper 24 is tilted, corresponding pivot hinges 69 will engage locking plates 64 mounted appropriately on frame 22.

Each end 70, 74 of the hopper 24, has an end wall 80 hingeally attached thereto by hinges 82 situated along end wall 80 at hopper bottom 72. Each end wall 80 therefore forms a hopper door that may be opened to allow easy dumping of debris 18 form the hopper 24. Each end wall 80 opens downwardly to allow removal of debris 18 from hopper 24. Hopper 24 is tiltable to a maximum angle $\alpha$ of approximately 40 degrees in either direction. When hopper 24 is tilted, the end wall 80 whose hinges 82 are at the vertex of the angle between frame base 23 and hopper bottom 72 may be opened to permit dumping of debris 18 from hopper 24. End wall 80 of hopper 24 is shown in its open position in FIG. 5. When end wall 80 is open as shown, end wall 80 serves as a ramp for debris 18. When end wall 80 is open as shown, bumper rubber 100 will serve to protect end wall 80 from damage when opened.

In operation, the retractable traversing trash rake 10 works as follows. Using the traversing motor, frame 22 is moved to a position adjacent a weedscreen 14 to be cleaned. When frame 22 has been moved close to the proper position, a control at control station 56 may be used to inch the frame 22 in small increments toward the precise location for proper cleaning. When frame 22 is in proper position, trolley motor 48 is actuated, and trolley 26 and the gripper rake assembly 34 carried by trolley 26 are moved from the first retracted trolley position 30 to the second extended trolley position 32, the trolley 26 travelling on guide rollers 27 which roll in tracks 29 of carrier beams 28. When trolley 26 is fully moved to its extended trolley position 32 the gripper rake assembly 34 is opened if it is not already open. Hydraulic assembly 45, hydraulic lines 44, and hydraulic cylinders 43 allow gripper rake assembly 34 to be opened and closed. A control on control station 56 will allow for the opening for the gripper rake assembly 34. When gripper rake assembly 34 is open and trolley 26 is in the extended position, gripper hoist motor 40 is actuated and gripper rake assembly 34 is lowered on hoist cables 42 to engage the bar grate or weedscreen 14 to be cleaned. Rear line assembly 38 of gripper rake assembly 34 engages bar 16 of the screen 14, and as gripper rake assembly 34 is lowered, debris 18 is cleaned from the weedscreen 14 and gathered by gripper rake assembly 34. When gripper rake assembly 34 has been lowered to bottom 46 of weedscreen 14, and all debris 18 has been cleaned from weedscreen 14, hydraulic assembly 45 is actuated, and hydraulic fluid flows through hydraulic lines 44 to actuate hydraulic cylinders 43 and close gripper rake assembly 34 so that front tine assembly 36 and rear tine assembly 38 engage to retain debris 18 within the gripper rake assembly 34. When gripper rake assembly 34 is closed, gripper hoist motor 40 is reversed to raise gripper rake assembly 34 and the retained debris 18 to the extended position 32. Once gripper rake assembly 34 has been fully raised, trolley motor 48 is actuated to retract trolley 26 and gripper rake assembly 34 to the retracted trolley position 30 within frame 22 directly above hopper 24. At this time, hydraulic assembly 45 is once again actuated to open gripper rake assembly 34 and deposit debris 18 into hopper 24. Once debris 18 has been dumped to hopper 24, the traversing motor may once again be actuated to move frame 22 to the next weedscreen 14 to be cleaned. The procedure is repeated until all weedscreens 14 to be cleaned have been cleaned.

Once the desired weedscreens 14 have been cleaned, or hopper 24 reaches its limit of holding debris 18, retractable traversing trash rake 10 may be moved by traversing motor to a dump location. When trash rake 10 has been moved to the dump location, the direction of dumping of the hopper 24 must be determined. Once this has been determined, the appropriate hopper hoist motor assembly 92 is actuated to retract the appropriate hopper hoist cables 90 onto cable drums 98, raising the appropriate end 70 or 74 of hopper 24 to the dumping position. When hopper 24 has been raised to the dumping position, the appropriate end wall 80 may be opened to allow dumping of debris 18 to the appropriate dump location. When debris dumping is completed, the appropriate end wall 80 is closed, the hopper 24 is lowered to its level position, and trash rake 10 may be traversed to another cleaning site.

Control station 56 will provide for manual operation of the trash rake 10, where all functions of trash rake 10 are under control of the operator. Appropriate safety interlocks and end of travel limit switches are included with the trash rake 10, and will override operator control. An appropriate panel enclosure may be provided. Indicator lights indicating such conditions as "ready to traverse" and "ready to inch" may also be provided at control stations 56. Once trash rake 10 is in an appropriate cleaning position, a "ready to rake" indicator may also be provided to indicate that cleaning may begin.

The detailed description outlined above is considered to be illustrative only of the principals of the invention. Numerous changes and modifications will occur to those skilled in the art, and there is not intention to restrict the scope of the invention to the detailed description. The preferred embodiments of the invention having been described in detail the scope of the invention should be defined by the following claims.

What is claimed is:

1. A traversing trash rake assembly for cleaning a weedscreen having a plurality of bays, comprising:

a frame having a pair of carrier beams extending substantially horizontally therefrom;

a collection hopper disposed within said frame;

a trolley movable along said carrier beams between a first retracted position above said hopper and a second extended position outside said frame;

raking means attached to said trolley and capable of being raised and lowered to collect debris from the weedscreen;

track means adjacent the weedscreen, said frame movably mounted to said track means and movable thereon to a plurality of cleaning locations each adjacent a weedscreen.

2. A traversing trash rake as described in claim 1, wherein said hopper is tiltably mounted to allow dumping of debris.

3. A traversing trash rake as described in claim 1, wherein said hopper is tiltably mounted at each end to allow dumping of debris to either end.

4. A traversing trash rake as described in claim 2, wherein said hopper has end walls, hingedly mounted to said hopper, said end walls opening to allow easier dumping of debris from said hopper.

5. A traversing trash rake as described in claim 4, wherein said hopper walls form a debris ramp when said hopper is tilted to a dumping position.

6. A traversing trash rake as described in claim 1, wherein said track means are rails.

7. A method for cleaning a weedscreen having a plurality of bays with a traversing trash rake assembly having a frame with a pair of carrier beams extending substantially horizontally therefrom, a collection hopper disposed within said frame, a trolley movable along said carrier beams between a first retracted position above said hopper and a second extended position outside said frame, raking means attached to said trolley and capable of being raised and lowered to collect debris from the bays, and track means adjacent the bays, said frame movably mounted to said track means and movable thereon to a plurality of cleaning locations each adjacent a bay, the method comprising the steps of:

positioning said frame adjacent a weedscreen;

moving said trolley from said retracted position to said extended position;

lowering said raking means to clean the weedscreen;

raising said raking means to remove debris from the weedscreen;

moving said trolley from said extended position to said retracted position within said frame;

dumping the removed debris from said raking means into said hopper; and repositioning said frame adjacent another weedscreen.

* * * * *

UNITED STATES PATENT AND TRADEMARK OFFICE

CERTIFICATE OF CORRECTION

PATENT NO. : 5,718,771
DATED : February 17, 1998
INVENTOR(S) : Cassell, et. al.

It is certified that error appears in the above-indentified patent and that said Letters Patent is hereby corrected as shown below:

Title page, item [57], In the Abstract, line 4, delete "troney" and insert --trolley--.

In col. 6, line 60, delete "line" and insert --tine--.

Signed and Sealed this
Thirtieth Day of June, 1998

*Attest:*

*Attesting Officer*

BRUCE LEHMAN

*Commissioner of Patents and Trademarks*